US010151507B2

(12) United States Patent
Santini et al.

(10) Patent No.: US 10,151,507 B2
(45) Date of Patent: Dec. 11, 2018

(54) REMOVABLE ACCESS PANELS AND TRANSITIONS IN HVAC SYSTEMS

(71) Applicants: Claudio Santini, Houston, TX (US); Nicholas Raissis, Houston, TX (US)

(72) Inventors: Claudio Santini, Houston, TX (US); Nicholas Raissis, Houston, TX (US)

( * ) Notice: Subject to any disclaimer, the term of this patent is extended or adjusted under 35 U.S.C. 154(b) by 517 days.

(21) Appl. No.: 14/448,765

(22) Filed: Jul. 31, 2014

(65) Prior Publication Data

US 2015/0082826 A1 Mar. 26, 2015

Related U.S. Application Data

(63) Continuation-in-part of application No. 14/034,861, filed on Sep. 24, 2013, now Pat. No. 9,267,702.

(51) Int. Cl.
*F24F 13/20* (2006.01)
*F24F 13/02* (2006.01)
*F24F 3/044* (2006.01)

(52) U.S. Cl.
CPC ..... *F24F 13/20* (2013.01); *F24F 3/044* (2013.01); *F24F 13/029* (2013.01); *Y10T 29/49815* (2015.01)

(58) Field of Classification Search
CPC ..... F24F 13/029; F24F 13/20; F24F 3/044
USPC ..... 285/126.1, 284.1; 454/355
See application file for complete search history.

(56) References Cited

U.S. PATENT DOCUMENTS 3,782,411 A * 1/1974 Turner ..... F24F 13/029 137/467
4,874,127 A * 10/1989 Collier ..... F24F 3/044 165/205
2005/0031819 A1* 2/2005 Mankell ..... B32B 5/26 428/36.91
2007/0066214 A1* 3/2007 Pettit ..... F24F 13/084 454/289
2008/0035307 A1* 2/2008 Yamakawa ..... B60H 1/00792 165/65
2012/0318381 A1* 12/2012 Arensmeier ..... F24F 13/222 137/395

FOREIGN PATENT DOCUMENTS

CA 2357078 A1 * 12/2002 ..... F24F 13/02

OTHER PUBLICATIONS

Pro-Fab Sheet Metal Inc. "Double Wall Rectangular Duct and Fittings", Sep. 1, 2013, retreived from http://www.profabsm.com/double-wall-rectangular-duct-and-fittings.html.*

* cited by examiner

*Primary Examiner* — Orlando E Aviles Bosques

(57) ABSTRACT

Methods and systems are disclosed with regard to a transition used in air conditioning systems. One embodiment may include an AHU, which may include a furnace, a motor and a blower. Further, the system may include a transition having at least one removable access panel, wherein the transition has a first opened end and a second opened end located opposite of the first opened end, wherein the first opened end securably aligns with an opened end of the furnace. Further still, the system may include a housing unit housing evaporator coils, wherein the second opened end securably aligns with one opened end of the box, further wherein the evaporator coils and the heat exchanging components of the AHU are accessible via the removable access panel.

19 Claims, 5 Drawing Sheets

REMOVABLE ACCESS PANELS AND TRANSITIONS IN HVAC SYSTEMS

RELATED APPLICATION

This disclosure claims the benefit of U.S. patent application Ser. No. 14/034,861 filed on Sep. 24, 2013, now U.S. Pat. No. 9,267,702, the entirety of which is repeated and incorporated herein by this reference.

FIELD OF DISCLOSURE

This disclosure generally relates to a transition for air conditioning systems having box evaporator coils or slab type evaporator coils ("coils"). More particularly, this disclosure relates to systems, methods and devices that involve a transition having one or more removable door panels, which permits in situ access to evaporator coils.

BACKGROUND

To maintain, improve, or fix the working condition of an air conditioning system, cleaning, repairing, or replacing its components may be necessary. Adequate access to these components, however, may prove difficult. For instance, with systems having evaporator coils ("coils"), reaching these malfunctioning, inefficient, or inoperable components often requires at least partial disassembly. After the particular problem with the coils is remedied, then the air conditioning system must be re-assembled and sealed. Accordingly, these subordinate processes wind up consuming the vast majority of time necessary to resolve the coil issue or an issue or maintenance issue with the forced air-handling unit ("AHU") adjoined to it. As a result, the time required to remedy the coil or AHU issue makes attendant costs so undesirable that a cost-efficient solution from a big-picture perspective may become replacing the used coils with a new coils or replace the AHU rather than merely remedying the particular problem with the used coils or AHU. Consequently, used coils or AHU's are replaced and new coils or AHU's are installed prematurely, a situation squandering time, money and materials.

SUMMARY OF THE INVENTION

In one embodiment, the system includes air conditioning system. The system may include a furnace having a motor and a blower or other type of forced air-handling unit (AHU). Further, the system may include a transition having at least one removable access panel, wherein the transition has a first opened end and a second opened end located opposite of the first opened end, further wherein the first opened end securably aligns with an opened end of the AHU, and further wherein the evaporator coils are accessible via the at least one removable access panel. Further still, the system may include a housing unit housing evaporator coils, wherein the second opened end securably aligns with one opened end of the box, further wherein the evaporator coils and the heat exchanging components of the AHU are accessible via the removable access panel.

In another embodiment, a method includes accessing an interior of an air conditioning system, such as its evaporator coils or the heat exchanging components of the AHU. The method may include unfastening one or more fastening devices that removably engage a removable access door from a frame, wherein the removable access door and the frame are the primary components of a removable access panel of a transition with the air conditioning system. Further, the method may include removing the removable access door from the frame. Further still, the method may include extending an object comprising an appendage, object or tool into the interior of the air conditioning system.

In yet another embodiment, a method includes making a transition, such as for use in accessing evaporator coils or the heat exchanging components of the AHU of an air conditioning system. The method may include adjoining a series of at least three members forming a perimeter of the transition, wherein the series comprises an end of a wall or a removable access panel frame adjoined to another end of another wall or removable access panel frame. Further, the method may include providing a removable access door that removably connects with the removable access panel frame via one or more fastening devices.

In still yet another embodiment, a device is a transition, which may be used for accessing an interior of an air condition system, such as its evaporator coils or the heat exchanging components of the AHU. The device may include a series of at least three insulated members that form a perimeter of the transition, wherein the series comprises an end of a wall or a removable access panel frame adjoined to another end of another wall or removable access panel frame. Further, the device may include a removable access door that removably connects with the removable access panel frame via one or more fastening devices. Further still, the device may include one or more pre-punched holes on one or more of the at least three members.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this disclosure and are therefore not to be considered limiting of its scope, for the disclosure may admit to other equally effective embodiments.

DETAILED DESCRIPTION OF THE EMBODIMENTS

The following is a detailed description of example embodiments of the invention depicted in the accompanying drawings. The embodiments are examples and are in such detail as to clearly communicate the invention. However, the amount of detail offered is not intended to limit the anticipated variations of embodiments; on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

In addition, directional terms, such as "above," "below," "upper," "lower," "front," "back," "top," "bottom," etc., are used for convenience in referring to the accompanying drawings. In general, "above," "upper," "upward," "top," and similar terms refer to a direction away the earth's surface, and "below," "lower," "downward," "bottom," and similar terms refer to a direction toward the earth's surface, but is meant for illustrative purposes only, and the terms are not meant to limit the disclosure.

Generally disclosed are methods and systems with regard to manufacturing and accessing evaporator coils ("coils") for transitioning within an air conditioning system having these coils. The coils, themselves, may be any type of coils, and, for instance, include box coils or slab coils, either of which may be in an arrangement that is horizontal, vertical, or a combination thereof. Example box coils include multipoise A-coil, performance A-coil, and N-coil.

Figure 1:
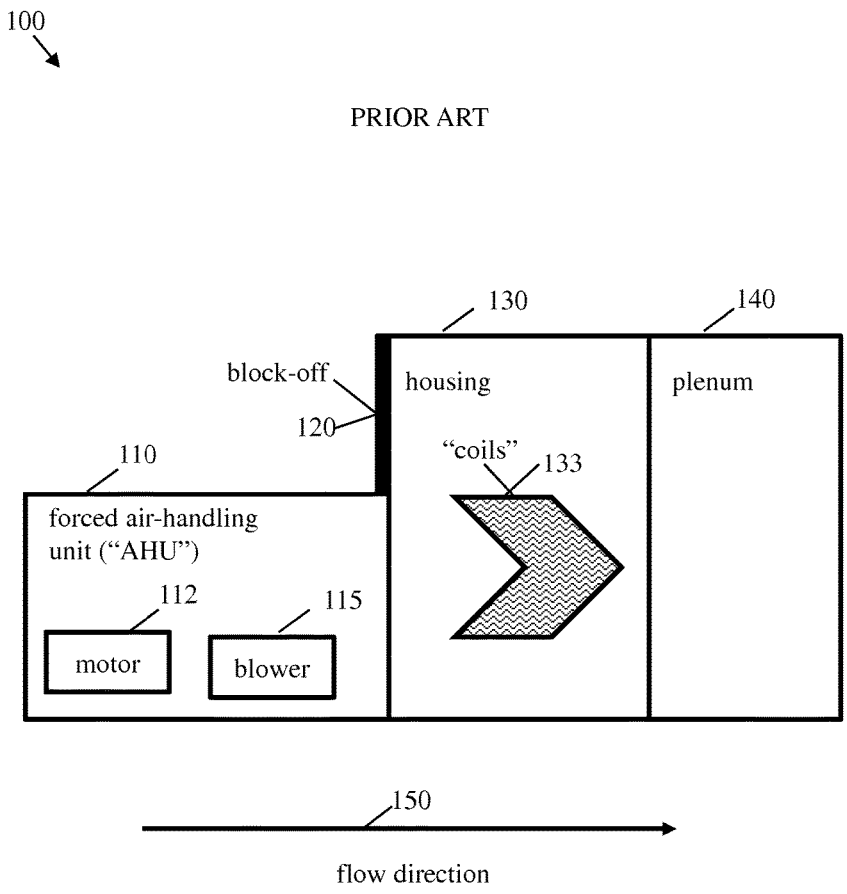
FIG. 1 depicts prior art of a side view of a system containing coils.

Turning now to FIG. 1, this figure depicts an example embodiment of a side view of the prior art. Here, the system 100 includes a forced air-handling unit ("AHU") 110 having a motor 112 and a blower 115 connected to a housing 130 having box evaporator coils or slab type evaporator coils ("coils") 133 therein 130. A plenum 140 connects to the housing 130 at a different place than where the AHU 110 connects to the housing 130; that is, at a place other than the one opened end 231 as depicted in FIG. 3. Returning to FIG. 1, the connection between the AHU 110 and the housing 130 permits the airflow 150 there through, but this airflow 150 is noticeably restricted by the block-off 120 connected to the housing 130. The block-off 120 accommodates for the mismatch between the opened-end interface of the AHU 110 connecting to the open-ended interface of the housing 130. That is, without the block-off 120, the system 100 would not be a closed system 100 because the airflow 150 would be disrupted on account of the housing 130 having an open-ended portion (i.e., equal to the surface area of the block-off 120) exposed to the surroundings of the system 100.

Figure 2:
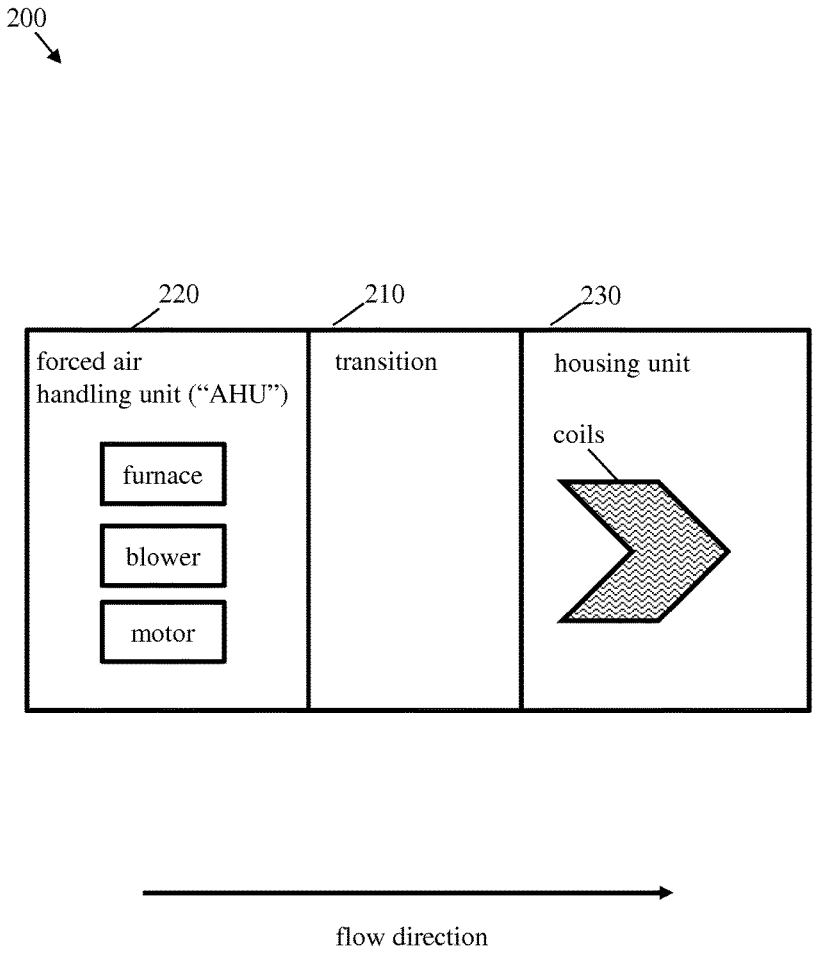
FIG. 2 depicts an example embodiment of a side view of a system in accordance with the disclosed methods and systems.

To circumvent problems in the prior art, such as those systems and problems discussed above, as well as provide further solutions to the industry, disclosed are methods and systems accompanied by the figures. As shown in FIG. 2, the system 200 is a closed system and includes a transition 210 that conjoins and flanks two components 220, 230, namely an AHU 220 and the housing unit 230 having the coils. The AHU, 220, for example, may include but is not limited to including a blower and a furnace, wherein each may be powered by gas, electric, solar or otherwise; the AHU 220 may include other components as well. The transition 210 may comprise any suitable shape to conjoint these components 220, 230. An example suitable shape for the transition 210, 310 is quadrilateral, such as that shown in FIG. 3. An example of a quadrilateral shape is trapezoidal.

Figure 3A:
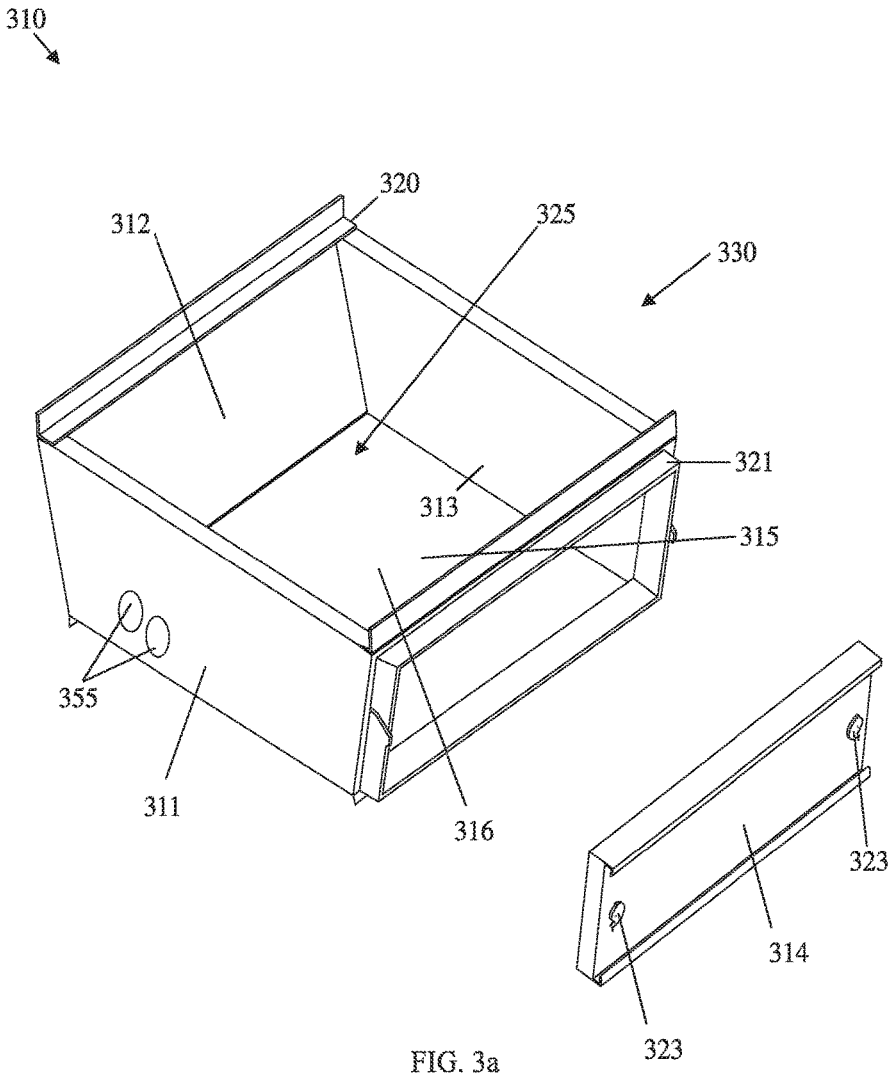
FIG. 3*a* depicts an example embodiment of a perspective view of a transition within a system in accordance with the disclosed methods and systems.

FIG. 3*a* illustrates a perspective view of part of a system, such as systems 200 and/or 400, having a transition 310 with a quadrilateral shape. In an example embodiment, the transition 310 may have three walls 311, 312, 313, a removable access door 314 and frame 321 (collectively referred to hereafter as "removable access panel") an open top 315, and an open bottom 316. The three walls 311, 312, 313 and removable access panel 314, 321, when the removable access door 314 is in an un-removed state (i.e., just the opposite of the depiction in FIG. 3*a*), may form a continuous, enclosed perimeter for the transition 310 in any one or combination of multiple ways. For instance, one of the three walls 311, 312, 313 or removable access panel's frame 321 may be welded at the end of one of the three walls 311, 312, 313 or removable access panel's frame 321 to adjoin, at a right angle in this case but the angle may be different in another example embodiment, with respect to the end of another one of the three walls 311, 312, 313 or removable access panel's frame 321, and so forth, in order to form a continuous, enclosed perimeter for the transition 310. In another example embodiment, one of the three walls 311, 312, 313 or removable access panel's frame 321 may be adjoined in another way to the end of another one of the three walls 311, 312, 313 or removable access panel's frame 321 at a right angle by another way, e.g., riveting, screwing, other fastening devices, or combinations thereof. In yet another example embodiment, one of the three walls 311, 312, 313 or removable access panel's frame 321 may be adjoined to the end of another one of the four walls 311, 312, 313 or removable access panel's frame 321 at a right angle by extruding at least part of the transition 310. And, in yet another example embodiment, at least two of the three walls 311, 312, 313 or removable access panel's frame 321 are integrally connected, wherein a right angle between the at least two of the three walls 311, 312, 313 or removable access panel's frame 321 is formed by molding, bending, folding, or otherwise manipulating material(s) comprising the at least two of the three walls 311, 312, 313 or removable access panel's frame 321 of the transition 310. To that end, the transition 310, itself, and any of its 310 components, may be made of one or more materials that include metal, plastic, wood, other suitable materials, or combinations thereof. Each edge 320, whether formed by adjoining, integrally connecting, or otherwise as previously disclosed or known, of the three walls 311, 312, 313 or removable access panel's frame 321 may be smooth, a desirable quality for safety and/or aesthetics.

Figure 3B:
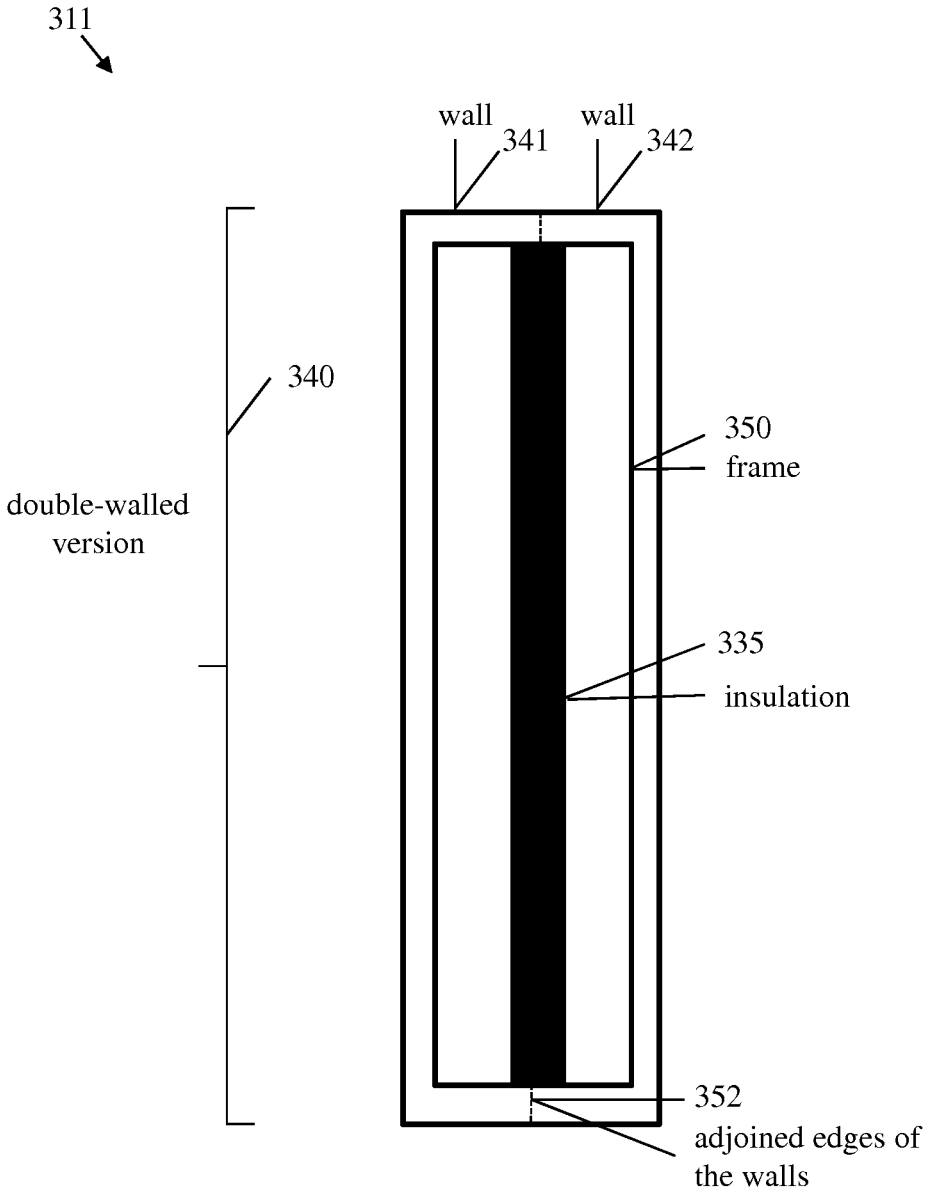
FIG. 3*b* depicts an example embodiment of a side view of a double-walled version having insulation therebetween, wherein the double-walled version may be used for any side, such as a wall or removable access panel, within a transition, and, furthermore, in accordance with the disclosed methods and systems.
Figure 4:
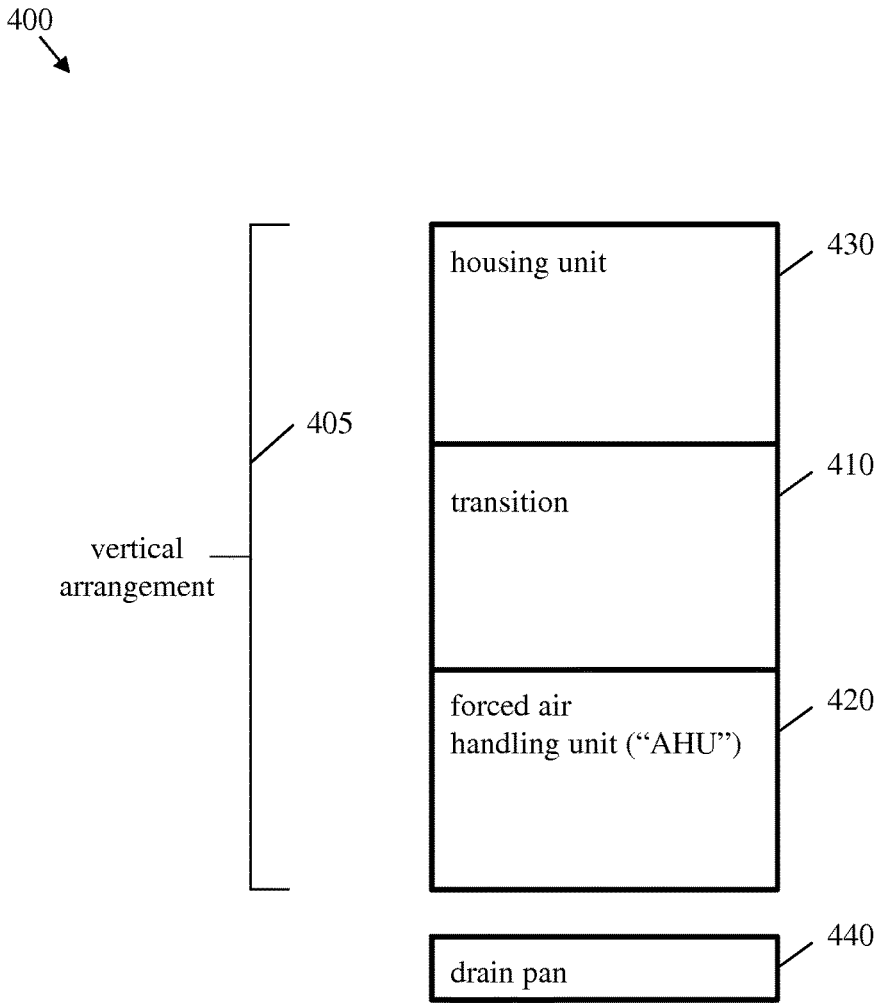
FIG. 4 depicts an example embodiment of a vertical arrangement of a system having a transition and a drain pan in accordance with the disclosed methods and systems.

One or more of the three walls 311, 312, 313 or removable access panel 314 may be proximate to insulation. In example embodiments, the insulation may be attached to any part(s) of the three walls 311, 312, 313 or removable access panel 314, 321, preferably within the interior 325 as opposed to the exterior 330, by adhesive, insulation pins, or other fastening devices. In another example embodiment, the insulation is not attached, but merely abuts part(s) of one or more of the three walls 311, 312, 313 or removable access panel's frame 321. In yet another example embodiment, the insulation, whether attached or not attached, is located between a double-walled version 340 of one or more of the three walls 311, 312, 313 or removable access door 314. That is, wall 311, for example, may be a double-walled version 340 that includes insulation 335 flanked by two walls 341, 342 as shown in FIG. 3*b*. A frame 350 may encapsulate the insulation 335 within each double-walled version 340, and, thereby, provide additional integrity to the transition 310. In such a case, one or more of the three walls 311, 312, 313 or removable access panel's frame 321 may still be adjoined at right angles in any of the manners previously described or known. Similarly, walls 341, 342 may have lips, folded edges, complimentary mating mechanisms, or otherwise to permit adjoining wall 341 to wall 342 (i.e., pictorially demonstrated as adjoined edge of the walls 341, 342) in any of the manners previously described or known. In other example embodiments, the double-walled version 340 has no internal frame 350. In line with energy-efficiency considerations, the system may contain insulated walls that are at least equal, i.e., meets or exceeds, the thermal resistance value ("R-value") of the system.

While additionally addressing size as well as shape, the transition 210, 310, itself, may be customized to a customer's size and shape requirements for his particular system 200, 300. In other embodiments, the transition 210, 310 may be manufactured in a range of industry-accepted sizes and shapes. In additional example embodiments, the transition 210, 310 may be manufactured in accordance with local building and/or energy code requirements. In still yet additional embodiments, the transition 210, 310 may be manufactured in a specific or range of R-values and/or meet governmental or industry requirements, accreditations, certifications, etc. Thus, in varying embodiments, the transition 210, 310 may be customized, readily available for off-the-shelf installation, or an embodiment therebetween.

When used in a system 400, such as one 400 having a vertical arrangement 405 of, for example, the AHU 420 and the housing unit 430 having the coils, but not to the exclusion of a horizontal or other arrangement, the transition 410 may work in tandem with a drain pan 440 within a closed system. The drain pan 440 may allow for collection of liquids resulting from drainage during maintenance, cleaning, installation, condensation, or other reason.

Returning to the discussion of the example embodiment having three walls 311, 312, 313 or removable access panel 314, 321 any one or more of these three walls 311, 312, 313 or removable access panel 314, 321 in this embodiment or others, may have one or more pre-punched holes 355 of any kind. The pre-punched holes 355 may permit a removable cap access that creates an opening when punched for a variety of reasons, e.g., installing and/or mounting of: ultraviolet radiant tube devices on the interior, exterior, or combinations thereof of any of the one or more of these three walls 311, 312, 313 or removable access panel 314, 321 having one or more pre-punched holes 355; air flow and air quality metering devices; heating, ventilation, and air conditioning ("HVAC") temperature, pressure and other types of probes or metering devices for testing temperature, pressure, and other metrics within the system 300, such as the coils. The mounting may be accomplished, for example, by any fastening devices and methods previously disclosed or otherwise known or available.

Now turning to the removable access panel 314, 321 shown in FIG. 3, a more detailed discussion ensues as to its 314, 321 disclosure and its 314, 321 various embodiments. The removable access panel 314, 321 provides access to the interior 325 of the transition 310 for cleaning, repairing, maintaining, or replacing of components, or for any other reason, by removing the removable access door 314 of a system, such as systems 100, 200, 400. The frame 321 is optionally recessed within the transition 310 and/or structurally reinforced to provide further integrity to the transition 310; structural reinforcement may be more of a concern in a vertical arrangement 405, as in system 400, as opposed to a horizontal arrangement, as in system 200. Reinforcement materials may include metal, plastic, wood, other suitable materials, or combinations thereof. In alternate, example embodiments, one of more of the three walls 311, 312, 313 may comprise removable access panel, such as removable access panel 314, 321 such that the transition 310 has more than one side having a removable access panel.

The removable access door 314 may be secured within the frame 321 of the removable access panel 314, 321 through one or more fastening device(s) 323. The fastening device(s) 323 may include swivel latch(es), spring clamp latch(es), spring pressure latch(es), hook(s) and loop(s), locks, and/or other devices that are located and operable on: (1) any part of the removable access door's 314 exterior 330, interior 325, in between the exterior 330 and interior 325, or combinations thereof; and (2) any part of the frame's 321 exterior 330, interior 325, in between the exterior 330 and interior 325, or combinations thereof. Through such fastening device(s) 323, the removable access doors 314 and the frame 321 collectively provide a removable access panel 314, 321, wherein a closed, removable access door 314 results in a closed system and an opened, removable access door 314 results in an opened system, such as the one depicted in FIG. 3. In further example embodiments, the interior perimeter of the frame 321 and/or the perimeter of the removable access door 314 may include a sealing material, such as rubber, to enhance the seal formed between the frame 321 and the removable access door 314 when the removable access panel 314, 321 is in a closed state. A system may include a sealing material in order to minimize leaks from and to a system that includes one or more removable access panels such as removable access panel 314, 321.

Turning to another aspect, disclosed are methods of accessing an interior of an air conditioning system. A method may include unfastening one or more fastening devices 323 that removably engage a removable access door 314 from a frame 320, wherein the removable access door 314 and the frame 320 are primary components of a removable access panel 314, 321 of a transition 310 for the air conditioning system. Further, the method may include removing the removable access door 314 from the frame 321. Further still, the method may include extending an object, such as an appendage, tool, or other object, into the interior of the air conditioning system. Here, the interior of the air conditioning system may be in the AHU and/or the housing unit housing the coils in order to clean, remove, replace, maintain or otherwise act on the air conditioning system and its components.

In yet another aspect, disclosed are methods of making a transition 314. The method may include adjoining a series of at least three members (314 and at least two of 311, 312, or 313, for example) and forming a perimeter of the transition 310, wherein the series (314 and at least two of 311, 312, or 313, for example) comprises an end of a wall (at least two of 311, 312, or 313, for example) or a removable access panel frame 321 adjoined to another end of another wall (at least two of 311, 312, or 313, for example) or removable access panel frame 321. The method may also include providing a removable access door 314 that removably connects with the removable access panel frame 321 via one or more fastening devices 323. During or after making the transition, the at least three members (314 and at least two of 311, 312, or 313, for example) may be insulated.

In still yet another embodiment, disclosed is a device having a series of at least three insulated members (314 and at least two of 311, 312, or 313, for example) that form a perimeter of the transition 310, wherein the series comprises an end of a wall (at least two of 311, 312, or 313, for example) or a removable access panel frame 321) adjoined to another end of another wall (at least two of 311, 312, or 313, for example) or removable access panel frame 321. The device may include a removable access door 314 that removably connects with the removable access panel frame 321 via one or more fastening devices 323. Additionally and alternatively, the device may include one or more pre-punched holes 355 on one or more of the at least three members (314 and at least two of 311, 312, or 313, for example).

While the foregoing is directed to example embodiments of the disclosed invention, other and further embodiments of the invention may be devised without departing from the basic scope thereof, and the scope thereof is determined by the claims that follow.

What is claimed is:

1. An air conditioning system comprising:

a forced air-handling unit;

a housing unit housing evaporator coils;

a transition located between the forced air-handling unit and the housing unit, the transition comprising four sides, wherein at least one of the sides comprises a removable access panel comprising a frame and a removable access door that is recessed within the frame about a perimeter of the removable access door, wherein the removable access door comprises a top side, a bottom side, a left side, a right side, a front side and a back side;

the perimeter comprises the top side, the bottom side, the left side and the right side;

the front side faces outside of the transition and the back side faces an interior of the transition;

the frame surrounds the top side, the bottom side, the left side and the right side of the removable access door without covering the front side;

the transition has a first opened end and a second opened located opposite of the first opened end, and wherein the first opened end securably aligns with and is connected to an opened end of the forced air-handling unit; and the second opened end securably aligns with and is connected to an opened end of the housing unit, wherein the evaporator coils are accessible via the at least one removable access panel.

2. The air conditioning system of claim 1, wherein the air conditioning system has an arrangement consisting of horizontal, vertical and combinations thereof.

3. The air conditioning system of claim 1, wherein the transition has a quadrilateral shape.

4. The air conditioning system of claim 1, wherein the transition has one or more walls.

5. The air conditioning system of claim 4, wherein the one or more walls are double-walled.

6. The air conditioning system of claim 5, wherein any of the one or more walls that are double-walled comprise an interior having insulation.

7. The air conditioning system of claim 1, wherein the transition has insulation in proximity to an exterior, an interior, or combinations thereof.

8. The air conditioning system of claim 7, wherein the insulation is attached by an adhesive, insulation pins, or fastening devices.

9. The air conditioning system of claim 1, wherein the frame is reinforced with one or more reinforcement materials.

10. The air conditioning system of claim 1, wherein the transition has a perimeter comprising a series of adjoining at least three members forming the perimeter, wherein the series comprises an end of a wall adjoined to another end of another wall or to the frame.

11. The air conditioning system of claim 10, wherein the series of adjoining comprises adjoining by weld, extrusion, integral connection fastening devices, or combinations thereof.

12. The air conditioning system of claim 10, wherein insulation is attached to one or more of the at least three members.

13. The air conditioning system of claim 1, wherein the frame removably connects with the removable access door via one or more fastening devices.

14. The air conditioning system of claim 1, wherein the at least one removable access panel comprises a sealing material in at least one location consisting of an inner perimeter of the frame of the at least one removable access panel, a perimeter of the removable access door of the at least one removable access panel, and combinations thereof.

15. The air conditioning system of claim 1, wherein the transition is customized to a shape, size, or both.

16. The air conditioning system of claim 1, wherein the transition has one or more pre-punched holes in at least one location consisting of the at least one removable access panel, one or more walls of the transition, and combinations thereof.

17. The air conditioning system of claim 16, wherein the air conditioning system comprises one or more meters, probes, or both that are installed on or mounted to the transition via punching through the one or more pre-punched holes.

18. The air conditioning system of claim 1, further comprising a drain pan for operation in tandem with the air conditioning system.

19. The air conditioning system of claim 1, wherein the transition has insulation having a thermal resistance value that is at least equal to the thermal resistance value of the air conditioning system without the transition.

* * * * *